US006859967B2

(12) United States Patent
Harrison et al.

(10) Patent No.: US 6,859,967 B2
(45) Date of Patent: Mar. 1, 2005

(54) OVERLAY MATTRESS

(76) Inventors: Samuel W. Harrison, 4003 Scenic Dr., Shreveport, LA (US) 71119; Patrick Quick, Sr., 155 Goldsby Cir., Stonewall, LA (US) 71078; Ralph W. Baucum, III, 851 Olive, Shreveport, LA (US) 71104

( * ) Notice: Subject to any disclaimer, the term of this patent is extended or adjusted under 35 U.S.C. 154(b) by 114 days.

(21) Appl. No.: 10/080,126

(22) Filed: Feb. 22, 2002

(65) Prior Publication Data

US 2003/0159219 A1 Aug. 28, 2003

(51) Int. Cl.[7] ..... A47C 27/14
(52) U.S. Cl. ..... 5/710; 5/713; 5/715
(58) Field of Search ..... 5/706, 710, 713, 5/715

(56) References Cited

U.S. PATENT DOCUMENTS

| | | | | | |
|---|---|---|---|---|---|
| 4,256,096 | A | | 3/1981 | Budde | |
| 4,538,311 | A | * | 9/1985 | Hall et al. | 5/686 |
| 4,542,547 | A | * | 9/1985 | Sato | 5/713 |
| 4,617,690 | A | | 10/1986 | Grebe | |
| 4,986,738 | A | | 1/1991 | Kawasaki et al. | |
| 5,090,077 | A | * | 2/1992 | Caden et al. | 5/713 |
| 5,560,057 | A | * | 10/1996 | Madsen et al. | 5/715 |
| 5,596,781 | A | * | 1/1997 | Graebe | 5/710 |
| 5,640,731 | A | | 6/1997 | Toedter | |
| 6,073,284 | A | | 6/2000 | Borders | |
| 6,079,065 | A | | 6/2000 | Luff et al. | |
| 6,119,292 | A | * | 9/2000 | Haas | 5/715 |
| 6,145,143 | A | | 11/2000 | Hicks et al. | |
| 6,182,316 | B1 | | 2/2001 | Thomas et al. | |
| 6,243,893 | B1 | | 6/2001 | Baldwin | |
| 6,260,220 | B1 | | 7/2001 | Lamb et al. | |
| 6,269,505 | B1 | | 8/2001 | Wilkinson | |
| 6,273,810 | B1 | | 8/2001 | Rhodes, Jr. et al. | |
| 6,290,716 | B1 | | 9/2001 | Augustine | |
| 6,295,675 | B1 | | 10/2001 | Ellis et al. | |
| 6,298,511 | B1 | | 10/2001 | Collymore | |
| 6,321,404 | B1 | * | 11/2001 | Tsai | 5/655.3 |
| 6,611,979 | B2 | * | 9/2003 | Welling et al. | 5/624 |

* cited by examiner

*Primary Examiner*—Teri Pham Luu
(74) *Attorney, Agent, or Firm*—Mark J. Young

(57) ABSTRACT

An overlay mattress has a plurality of internal elevating means, such as inflatable bladders, for raising selected portions of the mattress to achieve a wide range of patient positions. A fluid such as air may be supplied from a conventional surgical room air supply, a compressed canister, or a compressor to inflate the bladders. A fluid distribution system controls the flow of fluid to desired bladders. The overlay mattress may be used in conjunction with conventional surgical tables and mattresses. A thermal control means is also included in the overlay mattress to regulate a patient's body temperature. A pressure shifting means is also included to reduce the risk of bedsore formation.

43 Claims, 14 Drawing Sheets

OVERLAY MATTRESS

FIELD OF THE INVENTION

This invention relates to mattresses. More particularly, this invention relates to an overlay mattress for positioning a patient while providing comfort and support during various surgical procedures.

BACKGROUND

Many surgical procedures require positioning a patient on a surgical and/or procedure table in a certain way. The positioning may facilitate surgical and/or procedure access, shift a patient's organs in a certain direction, or increase or decrease blood flow to certain organs. Such positioning may include the left or right lateral tilting of the patient; the independent raising or lowering of the torso, seat, head and extremities of the patient; adjustment into the Trendelenburg position (head down, legs elevated) and reverse Trendelenburg position (head elevated, legs down); and adjustment into the flex position (head down, midsection up, feet down) and reflex position (head up, midsection down, feet up).

For example, the Trendelenburg position may be used to treat various conditions by increasing venous return and blood flow to a patient's heart to minimize the risk of shock. During subclavian or internal jugular access procedures involving cannulation, it is often necessary to increase venous return for vasodilitation (i.e., increasing the caliber of blood vessels) to facilitate the cannulation process. Additionally, during acute vagal responses, transient vascular and neurogenic reactions marked by a sudden decrease in heart rate and rapid fall in arterial blood pressure, prompt action is required. Further, acute hypotensive patients may benefit tremendously by increasing their cardiac output.

Reverse Trendelenburg positioning, which involves elevating the head, has been found useful to facilitate access to difficult to reach areas of the body. For example, such a position may use gravity to shift organs to a desired position.

Raising a patient's midsection has been found desirable during pericardiocentesis procedures, which entail inserting a pericardiocentesis needle just below the sternum (xyphoid process) to evaluate the cause of a chronic or recurrent pericardial effusion or to relieve cardiac tamponade. Such a position has also been found useful during acute pulmonary edema.

While various surgical and/or procedure tables having articulated tabletops may accomplish a desired range of motions, they have several drawbacks. First, many such tables are complex and not easily manipulated to desired positions. Additionally, because they are costly, such tables are often unavailable.

Another problem with conventional surgical tables (including those with articulated tabletops) is that patients often find the mattresses extremely uncomfortable. These mattresses tend to be thin, offering little or no support for certain areas of the body (e.g., the lumbar region).

Furthermore, conventional inflatable mattresses do not provide the range of elevations required to achieve the desired range of positions. Elevations of portions of a mattress of 18 inches or more may be required to achieve desired positioning of a patient during surgery and/or other procedures. While inflatable mattresses generally provide adjustable support and firmness characteristics, they typically accommodate a relatively limited range of positions.

Conventional surgical tables and mattresses do not address the thermal comfort and stability of the patient, which may require heating or cooling. During some procedures, such as open heart surgery and hyperthermia treatment, cooling may be desired. The benefits of maintaining normothermia are well known. Peri-operative hypothermia can have serious side effects for any patient, including a decrease in cardiovascular stability, an increase in oxygen consumption, and a decrease in resistance to infection.

Yet another disadvantage of conventional surgical tables and mattresses is that they do not provide means for reducing the risk of bed sores. Patients, particularly elderly and bedridden patients, may develop bed sores (i.e., decubitis or pressure ulcers) after a relatively short period of time due to the reduction of blood flow and therefor oxygen to soft tissue compressed by the weight of the patient. The oxygen-starved cells may eventually die causing ulcers. A patient susceptible to bed sores due to age or illness may suffer the onset or exacerbation of bed sores well within the time required for many surgical procedures.

Additionally, conventional surgical tables and inflatable mattresses also do not offer modularity. Instead, they are typically designed to provide a suite of functions without regard to a user's needs. For example, a plastic surgeon may wish to have an overlay mattress that offers only a Trendelenburg positioning function, while a postoperative acute care unit ("O.R. recovery room") may need an overlay mattress that provides only thermal control. Unnecessary functions and their controls may cause confusion, create risks of inadvertent activation, complicate maintenance and increase cost. A modular product could be tailored (by the manufacturer, vendor or user) to include those components that provide desired functionality, while excluding unnecessary components. Such modularity can simplify use, reduce risks, facilitate maintenance and decrease cost.

Thus, an overlay mattress is needed to facilitate patient positioning, provide thermal comfort and alleviate the risk of bed sores. The overlay mattress should be radiolucent, modular and work with existing operating room tables and mattresses. Additionally, the overlay mattress should achieve the desired range of positioning quickly and easily.

SUMMARY

The present invention pertains to a novel overlay mattress having a plurality of internal elevating means, such as inflatable bladders, for raising selected portions of the mattress to achieve a wide range of patient positions and support profiles. Where inflatable bladders are used, as in a preferred embodiment, a fluid such as air may be supplied from a conventional surgical and/or procedure room air supply, a compressed canister, or a compressor. The overlay mattress may be used in conjunction with conventional surgical tables and mattresses. A thermal control means is also included in the overlay mattress to regulate a patient's body temperature. To facilitate fluoroscopy and taking conventional X-rays, the overlay mattress is preferably comprised predominantly of radiolucent materials. In a modular implementation, various components such as certain elevating means and/or the thermal control means and/or pressure shifting means may be included in or omitted from the overlay mattress.

It is therefore an object of the present invention to provide an overlay mattress that may be used in conjunction with conventional surgical tables and mattresses.

It is another object of the invention to provide an overlay mattress that includes means for raising selected portions of the mattress to achieve a wide range of patient positions.

It is also another object of the invention to provide an overlay mattress that includes a plurality of inflatable bladders that may use conventional surgical room air supplies for selectively raising portions of the mattress to achieve a wide range of patient positions.

It is an additional object of the invention to provide an overlay mattress that includes thermal control means for regulating temperature of the mattress.

It is yet another object of the invention to provide a system and method for an adjustable overlay mattress that is easy to use.

It is a further object of the invention to provide an overlay mattress that is modular.

It is yet a further object of the invention to provide an overlay mattress that is substantially comprised of radiolucent materials.

It is still a further object of the invention to provide an overlay mattress that includes means for reducing the risk of bed sore formation and exacerbation.

BRIEF DESCRIPTION OF THE DRAWINGS

The foregoing and other objects, features and advantages of the present invention will become better understood with reference to the following description, appended claims, and accompanying drawings, where:

DETAILED DESCRIPTION

Figure 1:
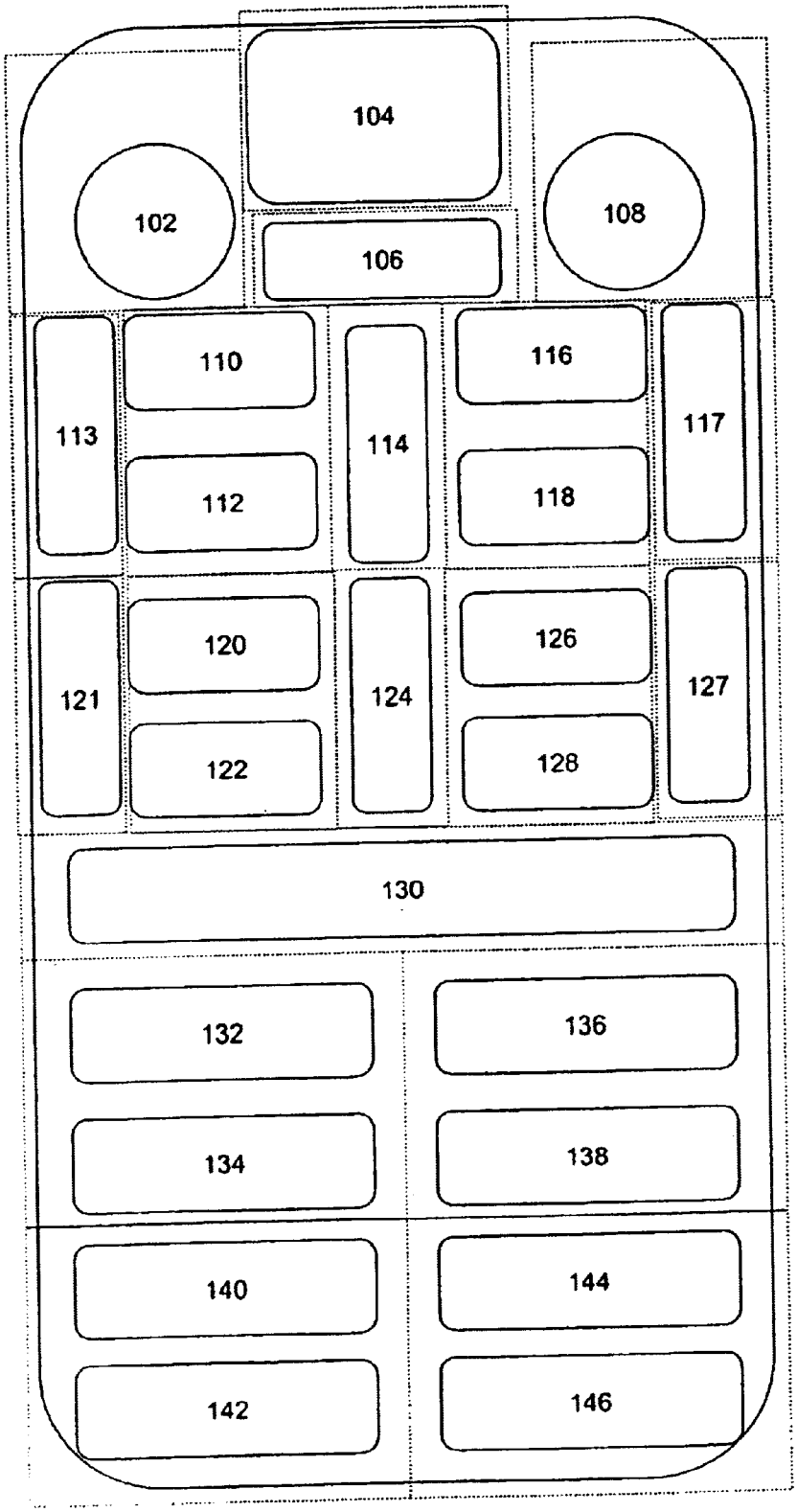
FIG. 1 is a schematic that conceptually shows a top view of an overlay mattress, including a plurality of zones and a plurality of inflatable bladders, in accordance with a preferred embodiment of the present invention.

Referring to FIG. 1, there is illustrated a top schematic view of an overlay mattress in accordance with a preferred embodiment of the present invention. The overlay mattress can be used in combination with any support device, such as a surgical and/or procedure table, where patient positioning capability may be desired. The overlay mattress is conceptually divided into a plurality of zones, each zone (surrounded by dotted lines) being proximate to a body portion when a patient lies on the mattress. For example, one zone may encompass the head, another zone may encompass the right shoulder region, yet another zone may encompass the left shoulder region, a fourth zone may encompass the right midsection, a fifth zone may encompass the left midsection, a sixth zone may encompass a portion of the spinal region and so on.

Each zone includes, within the mattress, at least one lifting cell for elevating that zone of the mattress. The lifting cells 102–146 may be comprised of various pneumatic, hydraulic, mechanical or electro-mechanical lifting means, though expandable bladders formed of pliable resilient radiolucent material, such as plastic (e.g., nylon reinforced polyurethane of approximately 0.10 to 0.20 mil thickness) or rubber, are preferred. The bladder should maintain its structural integrity when filled with a fluid and supporting a heavy patient. Such bladders may provide desired expandability, support and comfort at a relatively low cost, without undue complexity and weight. The bladders may be of various shapes and sizes, (e.g. as shown in FIGS. 3–5 and 11*a*–11*f*) for providing elevation, support and comfort in a zone.

Figure 6:
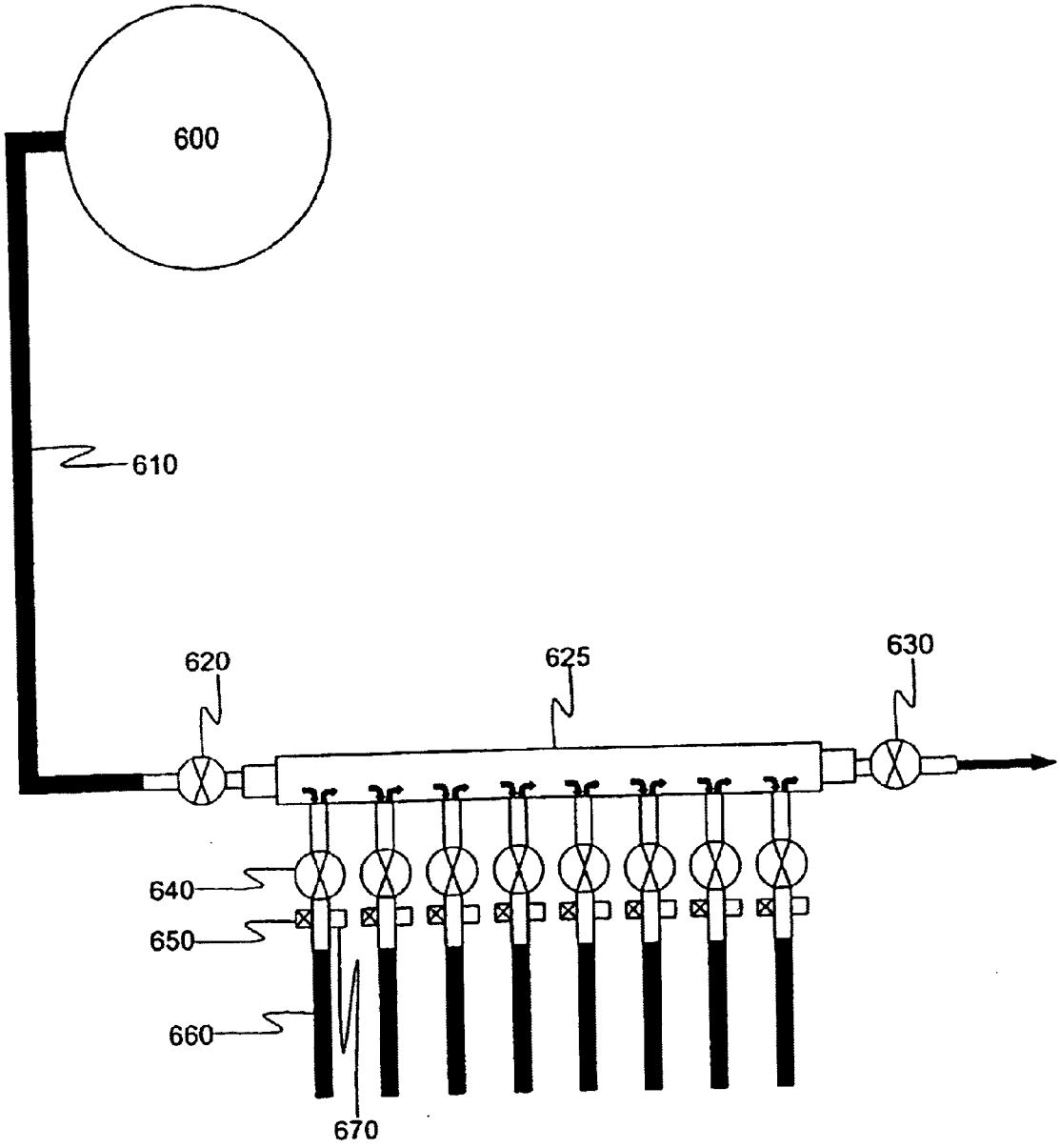
FIG. 6 is a schematic that conceptually shows an exemplary fluid supply source and a fluid distribution system in accordance with a preferred implementation of the present invention.

Each bladder includes an envelope for containing a fluid and an inlet (e.g., 320 in FIG. 3) for receiving fluid to inflate the bladder. The inlet is fluidly connected to a fluid distribution system (as shown in FIG. 6). The inlet may also be used to allow fluid to escape from a bladder. Each bladder may also include a pressure relief valve to prevent overpressurization, and an outlet for allowing fluid to escape from the bladder to an exhaust conduit.

Each bladder is preferably capable of inflation to a desired height. Bladders may be stacked to achieve a desired range of elevations. In some circumstances, elevations of eighteen inches or higher may be desired.

Figure 3:
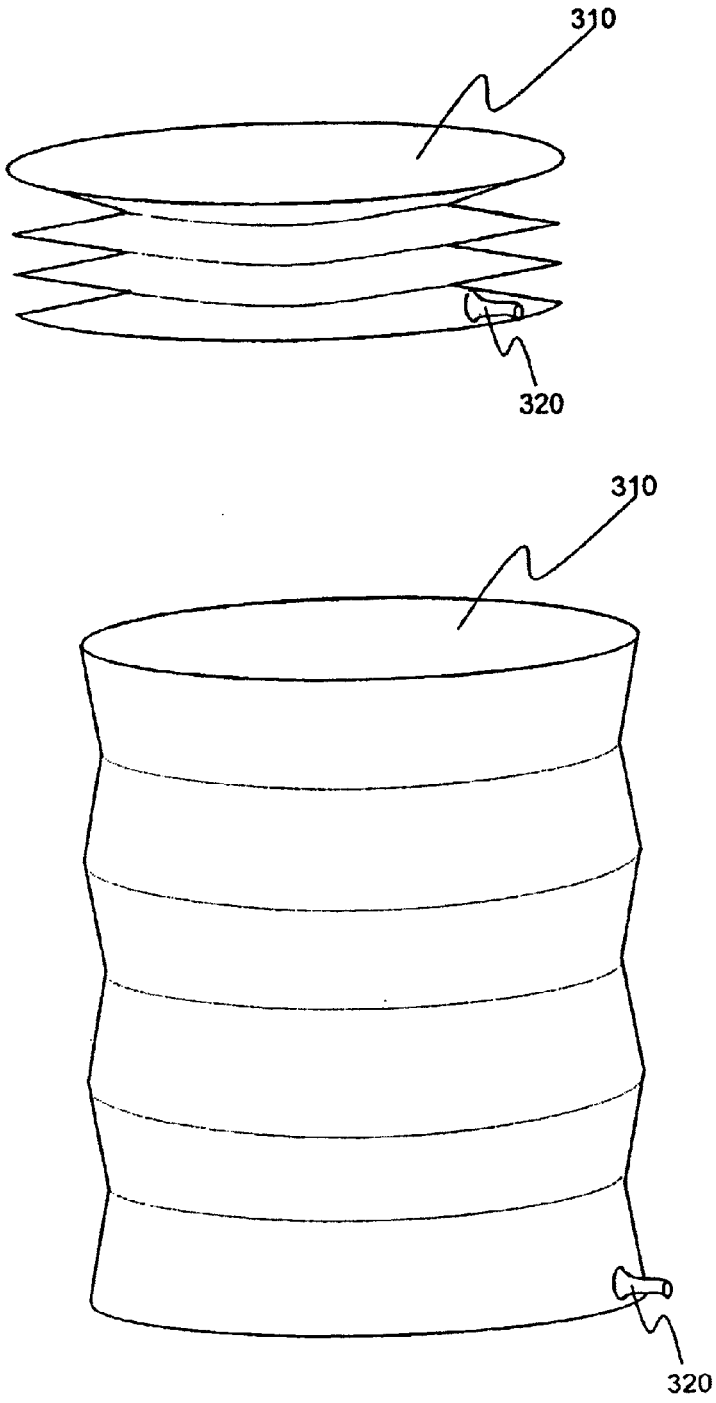
FIG. 3 is a schematic that conceptually shows an exemplary cylindrical inflatable bladder having bellows-like pleats, as a lifting cell, in uninflated and inflated modes, in accordance with a preferred implementation of the present invention.
Figure 4:
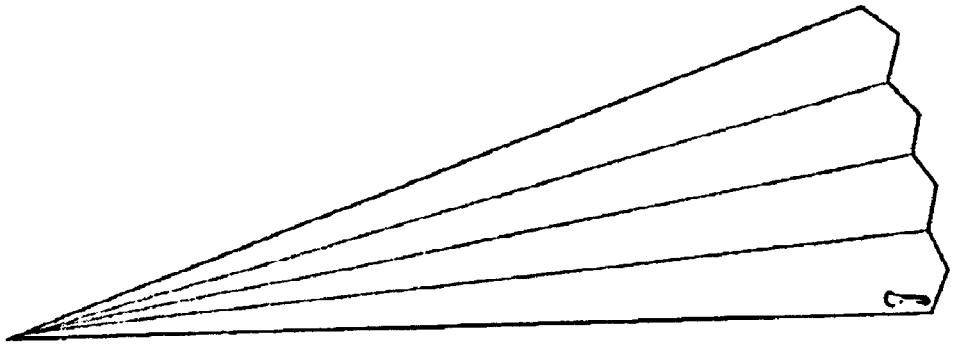
FIG. 4 is a schematic that conceptually shows an exemplary wedge-shaped inflatable bladder having bellows-like pleats, as a lifting cell, in an inflated mode, in accordance with an implementation of the present invention.
Figure 5:
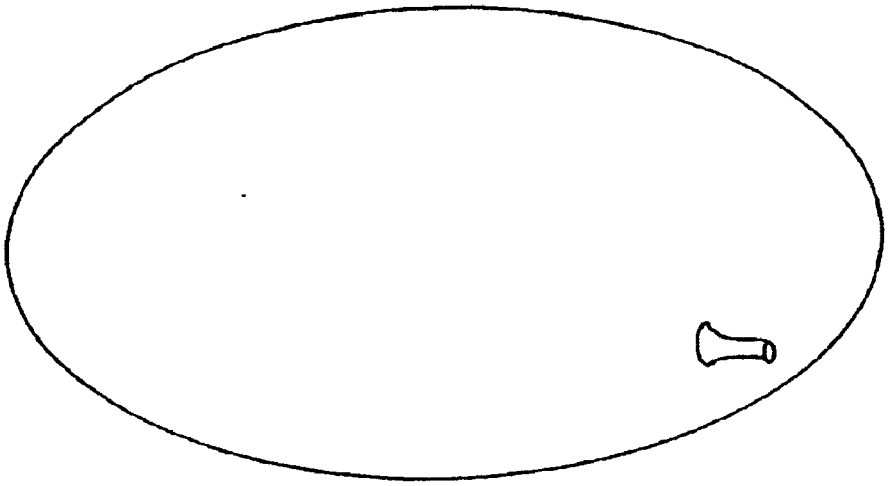
FIG. 5 is a schematic that conceptually shows an exemplary ellipsoid-shaped inflatable bladder having bellows-like pleats, as a lifting cell, in an inflated mode, in accordance with an implementation of the present invention.

In an exemplary embodiment, the bladder has a pleated bellows form to accommodate substantial expansion and orderly contraction primarily along a major axis. Referring to FIG. 3, a bladder may have a generally cylindrical shape with bellows-like pleats. Alternatively, a bladder may have a wedge-like or ellipsoid-shape, as in FIGS. 4 and 5, respectively. Bladders having other shapes may be used without departing from the scope of the present invention, provided that the bladders are capable of achieving a desired range of positioning.

Wedge-like shaped bladders may be stacked and/or arranged side-by-side, head-to-head or head-to-tail in a number of ways to achieve various positions. Stacking, as depicted in FIG. 11*a*, may be accomplished using releasable attachment means, such as Velcro® hook and loop fasteners. Either of the stacked bladders may be partially or fully inflated to achieve a desired inclined or declined plane. Additionally, both stacked bladders may be inflated to achieve an elevated level plane.

Pairs of wedge-like bladders, and or stacked pairs of wedge-like bladders, may be arranged to achieve various combinations of elevated level planes, inclined planes and declined planes, as shown in FIGS. 11*a* through 11*f*. Such surfaces may be particularly useful for positioning legs (e.g., knee up, or knee and calf up) and arms (e.g., elbow down and forearm inclined).

One or more wedge-like bladders may also be used to roll a patient onto his or her side or roll a patient over. To illustrate, one or more wedge-like bladders may be positioned with the elevatable end of the bladder being adjacent to the left side of the overlay mattress such that inflation will cause the left half of the mattress to elevate, creating an inclined plane with the lower end being near the middle of the mattress. The inclined plane will tip a patient along his or her side and facilitate turning the patient onto his or her side or rolling the patient over, requiring less bending and lifting than needed to accomplish the move without the incline. Once the patient is securely in the desired position, the wedge-like bladders may be deflated. One or more wedge-like bladders may also be positioned with the elevatable end of the bladder being adjacent to the right side of the overlay mattress, thus facilitating rolling the patient to the left side. Such an application may be particularly useful in nursing homes, assisted living facilities and the like, to facilitate such repositioning for purposes such as cleaning a bedridden patient, repositioning to reduce the risk of bedsores and changing linens.

The bladders may be secured to the bottom layer of the mattress using various attachment means. In a preferred embodiment, releasable attachment means are employed, such as Velcro® type hook-and-loop attachments on the bottom of each bladder and on the top of the bottom layer 250 of the mattress. This allows replacement of damaged bladders, without replacement of the entire mattress. It also allows reconfiguration of the bladders to accommodate various body sizes and overlay mattress configurations.

Figure 2:
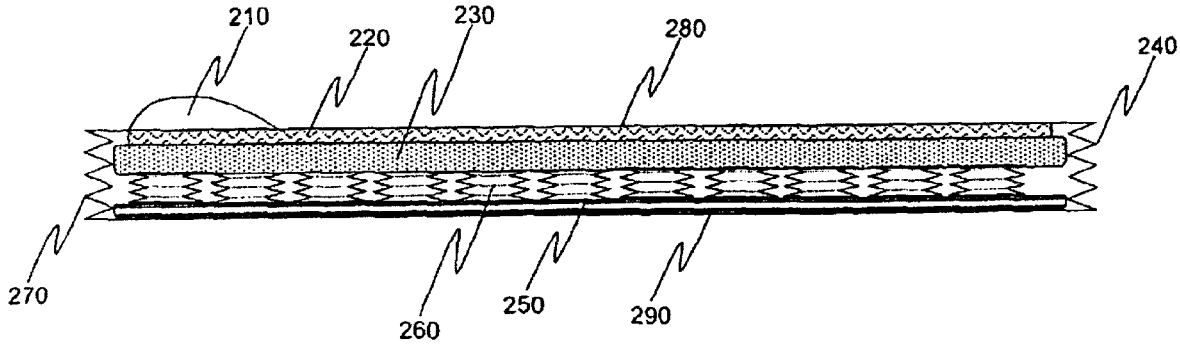
FIG. 2 is a cross-sectional view of an overlay mattress, including bellows-like pleats to neatly contain excess mattress material, in accordance with a preferred embodiment of the present invention.

Referring now to FIG. 2, a side cross-sectional view of an exemplary overlay mattress in accordance with the present invention is shown. The overlay mattress is comprised of an overlay mattress cover and a plurality of internal layers. The cover includes a top (patient support) surface 280, a bottom surface 290, left and right side surfaces (not shown) and head-end 270 and foot-end 240 surfaces. Bellows-like pleats provide excess material to allow orderly expansion and contraction of the mattress cover along the head-end 270 and foot-end 240 surfaces. Similar pleats may be provided along the left and right side surfaces to facilitate orderly expansion and contraction of the mattress cover along those sides.

Figure 12:
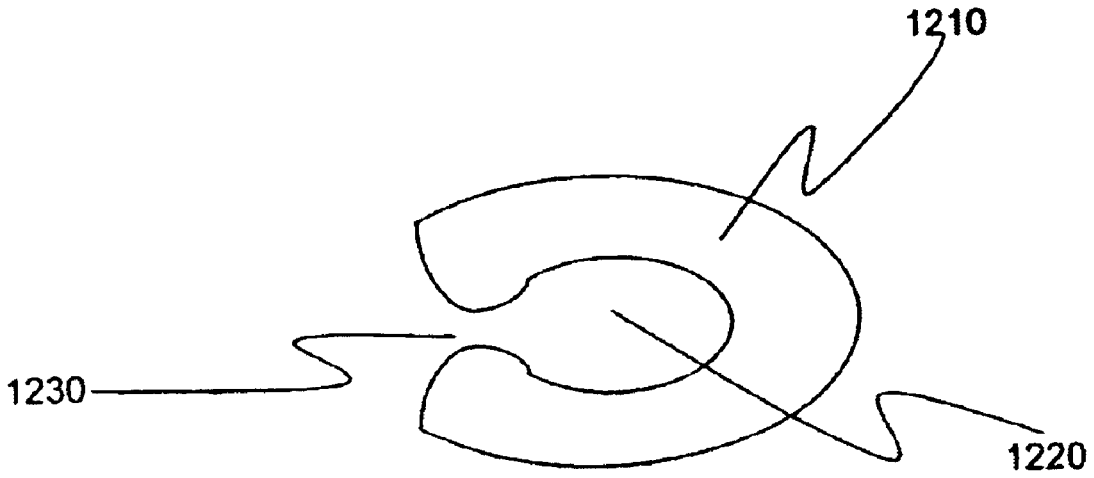
FIG. 12 conceptually shows a top view of an inflatable pillow for elevating a patient's head face down without obstructing breathing.

A pillow 210 may also be provided on the top surface of the overlay mattress. The pillow may be inflatable to provide a range of firmness and elevation. In a preferred embodiment, the pillow may be removed and replaced with an inflatable bladder to support a patient's head during face-down procedures. The bladder may be substantially horseshoe-shaped, such as 1210 as shown in FIG. 12. When inflated, the bladder elevates and provides support to the patient's head. A void 1220 prevents the inflated bladder and underlying tabletop or mattress from obstructing breathing. Support is provided substantially around the face of the patient. An opening 1230 affords access and visibility to the patient's face. The bladder may inflate so that the top is substantially level, or may provide an incline, such that the side having the opening 1230 is slightly higher than the opposite side when the bladder is inflated. As will be apparent to those of ordinary skill in the art, other inflatable and non-inflatable devices may be used in conjunction with an overlay mattress in accordance with a preferred embodiment of the present invention to safely support a patient's head face-down without obstructing breathing.

While the cover may be comprised of various materials, preferably a liquid impermeable, pliable, durable, comfortable material is used. Liquid impermeability helps protect (i) the internal components of the overlay mattress from exposure to fluids from outside the cover which may contaminate internal components of the mattress, and (ii) a patient from exposure to liquids contained within internal components of the mattress in the event of internal rupture or leakage. If the overlay mattress will be used in an operating room or under conditions involving use of sharp implements, the cover material should be resistant to punctures, cuts and tears. Such resistance will help prevent exposing the internal components of the overlay mattress to contaminants, while protecting the components from physical damage due to dropped and misplaced scalpels, needles and other sharp or pointed instruments. Accidental puncture of an inflated bladder and consequential inadvertent repositioning of a patient can cause serious problems, especially during delicate surgical procedures.

The internal layers preferably include a thermal layer 220, a cushion layer 230, a lifting cell layer 240 and a bottom layer 250. The thermal layer 220 is adjacent to the top surface and its temperature is preferably controlled by a thermal control system. The cushion layer 230 is preferably comprised of pliable foam material, or a fluid filled bladder (or plurality of bladders) to provide comfort and support. The lifting cell layer 240 includes a plurality of lifting cells that may individually or in combinations be raised or lowered to provide a range of elevated support. The bottom layer 250 is preferably comprised of a rigid or semi-rigid, durable, radiolucent material (e.g., a thin rigid plastic sheet) to which bladders may be releasably secured. Fewer or additional internal layers may be included without departing from the scope of the present invention.

The layers may be configured so that each layer couples to one or two adjacent layers. For example, the thermal layer may couple to the cushion layer, which may couple to the lifting cell layer, which may couple to the bottom. Preferably, releasable attaching means, such as Velcro® hook and loop fasteners, snaps, belts and or straps, are used to couple the layers.

In certain implementations, layers may be combined. Thus, for example, a cushion layer comprised of one or more bladders containing a thermally regulated fluid, may also serve as the thermal layer.

Preferably, the overlay mattress is modular and adaptable. Bladders may be removed and replaced with inserts of foam rubber or other comfortable support material. Releasable attachment means may be employed to secure inserts to bottom layer 250 of the mattress, such as Velcro® type hook-and-loop attachments on the bottom of each insert and on the top of the bottom layer 250 of the mattress. The bottom layer 250 of the mattress, with bladders attached, may be removed from the overlay mattress for adaptation. Thus, for example, a plastic surgeon wishing to have an overlay mattress that offers only a Trendelenburg positioning function may remove all unnecessary bladders (or have them removed), potentially simplifying use, reducing risks of use, facilitating maintenance and decreasing cost. Inserts would be provided in place of the unnecessary bladders. Then the bottom layer 250 of the mattress, with bladders and inserts attached, may be reinserted into the overlay mattress.

Figure 8:
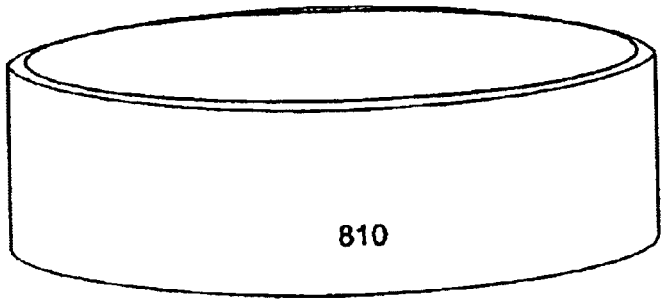
FIG. 8 conceptually shows a telescoping sleeve surrounding a cylindrical inflatable bladder in accordance with an implementation of the present invention.
Figure 8:
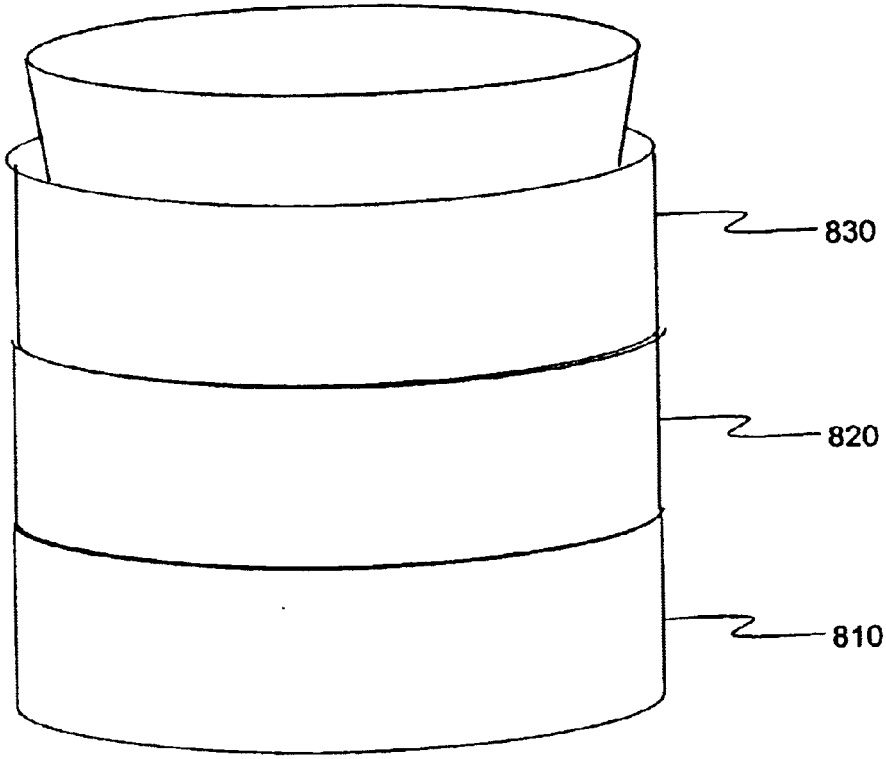

Application of an external load on the mattress will cause the bladders to deform into a compressed form, except to the extent a reforming means prevents such deformation. The overlay mattress may include a resilient foam material between each bladder. The foam may act as a reforming means that is capable of providing a reforming or constraining force around the bladders. Alternatively, a plastic sleeve having a plurality of telescoping sections (810 to 830) may surround the side(s) of each bladder, as shown in FIG. 8, acting as a reforming means. The top telescoping section 830 is coupled (preferably releasably coupled) to a top portion of the bladder using conventional attachment means. Likewise, the bottom telescoping section 810 is coupled (preferably releasably coupled) to a bottom portion of the bladder and/or the bottom layer of the mattress. As a bladder is inflated and rises, the telescoping sleeves (810–830) may extend, maintaining a constraining force around the inflated bladder.

In a preferred embodiment, the thermal layer 220 regulates the temperature of the surface of the overlay mattress by heating and or cooling. A heating controller regulates the temperature of the thermal layer. For example, the thermal layer may include an electrical heating element of the sort used in therapeutic heating pads to provide heat to a patient lying on top of the overlay mattress. A controller may regulate the temperature of the electrical heating element by regulating the electrical current supplied to the electrical heating element. Preferably, the heating layer is pliable in all directions and controllable to within approximately a few degrees of a desired temperature. Illustratively, thermal layer 220 may include a conductive thermal material (such as Gorix™, a carbonized, electro-conductive, radiolucent textile) which provides uniform heat across the material when low-voltage electricity is supplied to the material.

In addition to (or in lieu of) an electrical heating element as described above, the thermal layer 220 may include one or more thermal bladders for containing a thermal fluid at a desired temperature. The thermal fluid is preferably water or air, although any stable, safe fluid or gel that flows and has a suitable heat capacity can be used without exceeding the scope of the present invention. For example, each thermal bladder may contain heated or cooled water to heat or cool the patient-supporting surface of the overlay mattress. Means for heating the fluid may include conventional fluid heating means, such as an electrical resistance heating element, a heat pack, a heating coil of a conventional heat pump or a hot surface of a Peltier heat pump, in thermal communication with the fluid. Means for cooling the fluid may include conventional cooling means, such as a cooling pack, a cool surface of a Peltier heat pump, or a cooling coil of a heat pump or refrigeration unit, in thermal communication with the fluid. To improve heat transfer from the heating or cooling source, the thermal fluid may be circulated from the bladder to a point in close thermal communication (e.g., directly in contact or in close proximity) with the heating or cooling source. Such circulation may be required to efficiently maintain the thermal fluid at a desired temperature for an extended period of time, especially where the heating or cooling source is external to the overlay mattress. Means for circulating-the fluid may include a fluid pump. As will be understood by those skilled in the art, various other means for heating or cooling may be applied without deviating from the scope of the present invention.

Figure 9:
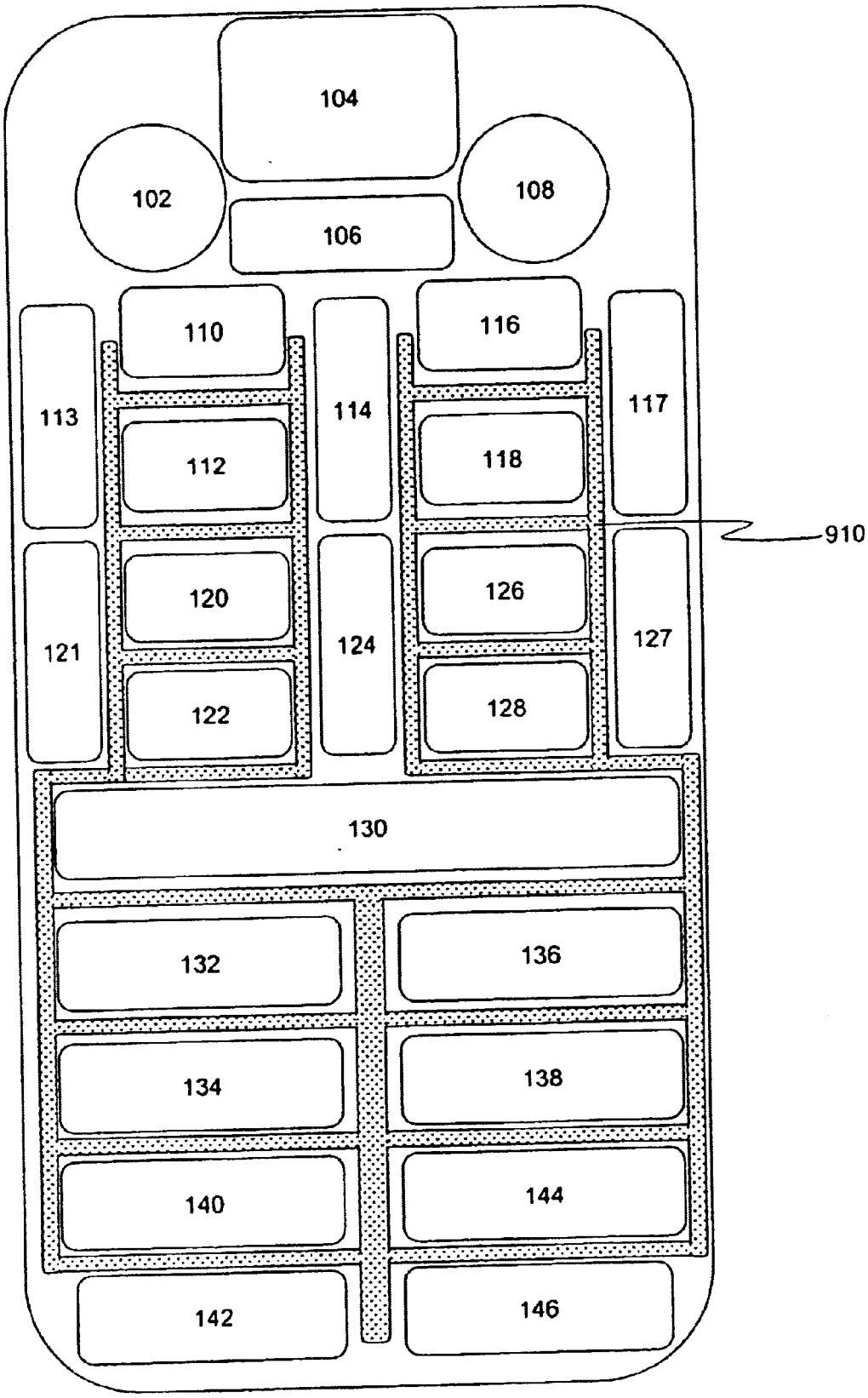
FIG. 9 conceptually shows a top view of an overlay mattress, including a conduit network for containing a fluid to provide heating or cooling.
Figure 10:
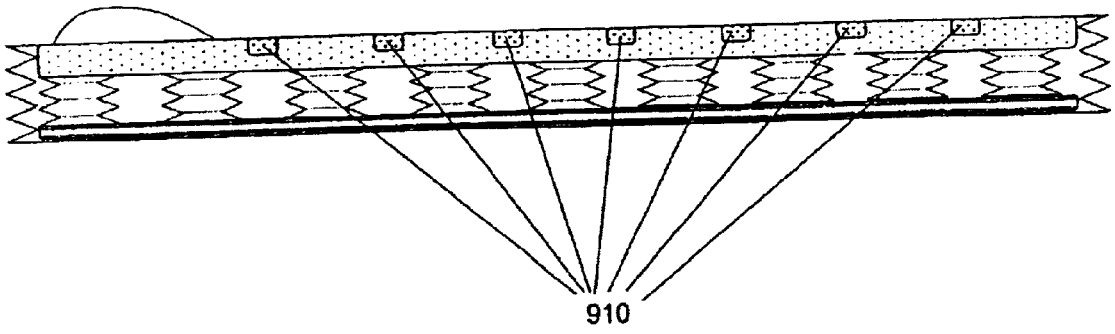
FIG. 10 conceptually shows a side cross sectional view of an overlay mattress, including the conduit network for containing a fluid to provide heating or cooling.

Though the thermal bladder may include a relatively flat, fluid filled bladder, other geometries are possible and come within the scope of the present invention. For example, the thermal bladder may comprise a serpentine arrangement or network of ducts or conduits 910 containing a thermal fluid at a desired temperature, as illustrated in FIGS. 9 and 10. The conduits 910 may be integrated with or reside in channels at or near the top of the cushion layer 230, for example, as shown in the cross-sectional side view of FIG. 10. As the conduits may be slightly recessed in the channels, the cushion layer may support most of the weight of the patient, possibly reducing pumping requirements for fluid recirculation through the conduits. The thermal fluid may be heated or cooled using conventional fluid heating and cooling means, preferably with circulation means, as described above.

As the overlay mattress is modular and adaptable, the thermal layer 220 or its associated heating and/or cooling means may be removed or omitted for applications where thermal control is unnecessary. Additionally, bladders (i.e., lifting cells) may either be removed and replaced with inserts or inflated equally to provide uniform (substantially level) support, where only thermal control is desired. For example, a postoperative acute care unit ("O.R. recovery room") may need only temperature control.

The overlay mattress preferably includes means for releasably attaching the mattress to a conventional surgical and/or procedure table or surgical and/or procedure mattress. Such attachment means may include straps, belts and the like.

Referring now to FIG. 6, a fluid supply source 600, an inflow line 610 and a fluid distribution system 620–670 are shown. The fluid supply source 600, fluidly connected to the fluid distribution system by inflow line 610, supplies pressurized fluid to the fluid distribution system 620–670. Preferably, the supplied fluid is air, although, any suitable fluid, e.g., water or nitrogen, can be used. In the case of air, the fluid source 600 may be a supply of compressed air that typically can be found in operating or procedure rooms, a tank of compressed air, or an air compressor or pump, or some combination of the foregoing. The inflow line 610 preferably includes releasable connectors such as Luer-Lock connectors to releasably connect the line to the fluid supply source 600 and to an inflow valve 620 fluidly coupled to a manifold 625 of the fluid distribution system. The inflow line 610 is a tube or hose made of any material capable of delivering the fluid under pressure. Preferably the line is comprised of a flexible, resilient, durable material, and may be coated or jacketed to prevent damage.

The fluid distribution system preferably includes a manifold 625, a plurality of inlet valve assemblies 640 and inlet lines 660 for delivering fluid to bladders. As with the inflow line 610, the inlet lines 660 are tubes or hoses made of any material capable of delivering fluid under pressure. Preferably the lines are comprised of a flexible, resilient, durable material, and may be coated or jacketed to prevent damage. The inlet valves 640 control the flow of fluid from the manifold 625 to inlet lines 660 serving bladders within the zones. Preferably, one valve controls the flow of fluid from the manifold to one inlet line, which may branch off, serving a plurality of bladders within one zone, or may serve a single bladder within a zone. It will be appreciated by those skilled in the art that use of the manifold 625 enables the overlay mattress to use one source of pressurized fluid (i.e., the fluid supply source 600) to service all zones and all lifting cells, rather than requiring a separate source of pressurized fluid for each bladder.

Figure 7:
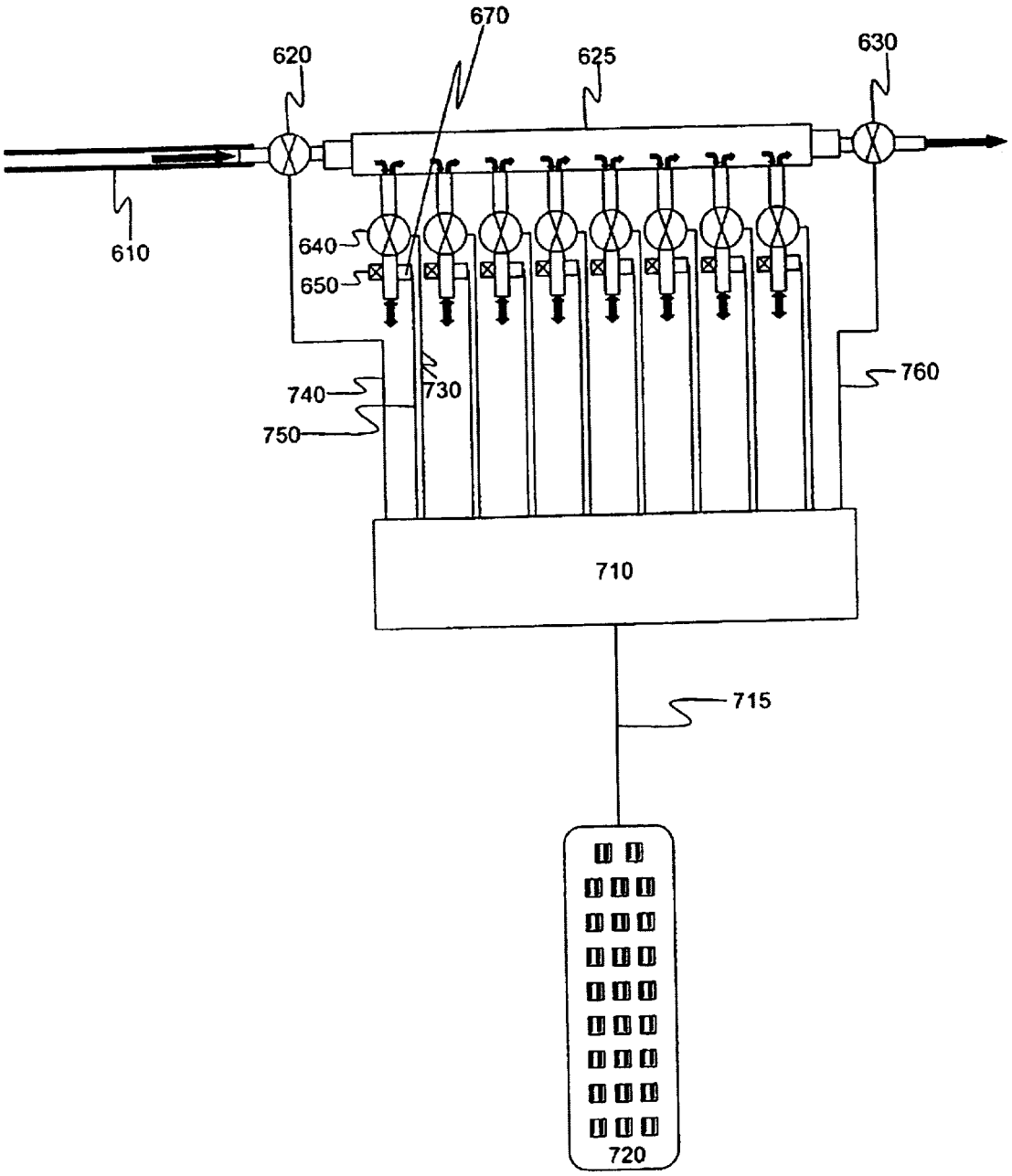
FIG. 7 is a schematic that conceptually shows an exemplary control system for a fluid distribution system in accordance with a preferred implementation of the present invention.

While manually controlled valves may be used, preferably the valves are electronically activated (i.e., opened and closed) valves, such as piezoelectric or conventional solenoid controlled valves, opening and/or closing in response to electrical signals from a controller, 710 as depicted in FIG. 7. When opened, an inlet valve 640 allows fluid to flow to and from the manifold 625 to and from the inlet line 660 fluidly coupled to the valve, thereby allowing fluid to flow to and from bladders within the zones. Preferably, one valve controls the flow of fluid from the manifold 625 to one inlet line 660, which may branch off, serving a plurality of bladders within one zone. Thus, assuming the overlay mattress includes eight zones and each inlet line 660 serves all of the bladders in a zone, then the fluid distribution system may include eight valves such as 640, one for each zone.

The fluid distribution system may also include a pressure relief valve, such as 650, and a pressure sensor, such as 670. The pressure relief valve 650 controls the maximum pressure level of the fluid in the inlet line 660 and bladders served by the inlet line, preventing over-inflation. The maximum pressure should be sufficient to allow full inflation of all bladders served by the inlet line while providing support to a heavy patient. The pressure sensor 670 may be an analog gauge providing a pressure readout, or an electrical sensor providing a signal representative of the pressure.

The fluid distribution system may also include an inflow valve 620 fluidly coupled to the manifold 625, between the fluid source 600 and manifold 625. When opened, the inflow valve 620 allows fluid to flow from the fluid source to the manifold. When closed, the inflow valve 620 prevents fluid from (i) escaping through it from the manifold and (ii) entering the manifold. The inflow valve 620 can serve to release the fluid source 600 from the manifold 625 without losing bladder pressurization in the event that the fluid source 600 must be used for other purposes (e.g., air driven tools). In combination with the exhaust valve 630, the inflow valve 620 can serve a safety measure, assuring that the mattress or a zone, once inflated, does not deflate in the middle of a procedure as a result of an inlet valve 640 failure.

The fluid distribution system may also include an exhaust valve 630 fluidly coupled to the manifold 625. When opened, the exhaust valve 630 allows fluid to escape the manifold 625. When it is closed, fluid cannot escape from the manifold 625 through the exhaust valve 630. Where the fluid is air, the fluid may escape from the exhaust valve 630 into the atmosphere. Otherwise, exhausted fluid may enter an exhaust conduit, which may lead to a reservoir.

The fluid distribution system may be contained within the overlay mattress or within a container that may be positioned adjacent to the overlay mattress. If radiolucency is desired and the fluid distribution system includes metallic or other radiopaque components, it should be positioned outside of (e.g., adjacent to) the overlay mattress.

Referring now to FIG. 7, means for controlling activation of the electronically activated valves ("control means") according to a preferred embodiment, may include a controller 710 (such as a programmable logic controller that performs "ladder logic" operations for implementing a control program and which provides output signals based on input signals provided by an operator or otherwise acquired). According to alternative embodiments, other suitable controllers of any type may be included in the control means provided they are capable of generating signals for opening and closing the electronically activated valves based on input signals. For example, controllers of a type that may include a microprocessor, microcomputer or programmable digital processor, with associated software, operating systems and/or any other associated programs to collectively implement a control program may be employed. According to alternative embodiments, the controller and its associated control program may be implemented in hardware, software or a combination thereof, or in a central program implemented in any of a variety of forms.

A means for a user to provide input signals to the controller, such as a hand-held controller 720, may be used to send command signals to controller 710, via electrical (or wireless) communication means 715, to control the opening and closing of valves. In a particular embodiment, the hand held-controller 720 may include controls representative of certain pre-defined desired positions, such as the Trendelenburg position (head down, legs elevated), reverse Trendelenburg position (head elevated, legs down); flex position (head down, midsection up, feet down) and reflex position (head up, midsection down, feet up). Upon activating such a control, the hand-held controller 720 may send command signals to controller 710 via electrical (or wireless) communication means 715 to control the opening and closing of valves to achieve the desired position.

Controller 710 may thus receive user input (e.g., from hand-held controller 720 via conventional electrical (or wireless) communication means 715). Controller 710 may also receive pressure sensor signals from pressure sensors 670 via conventional electrical (or wireless) communication means 750. Additionally, controller 710 may transmit signals to control the opening and closing of inlet valves 640 via conventional electrical (or wireless) communication means 730. Furthermore, controller 710 may transmit signals to control the opening and closing of inflow valve 620 and exhaust valve 630 via conventional electrical (or wireless) communications means 740 and 760.

To inflate a bladder, exhaust valve 630 is closed and inflow valve 620 is opened. Additionally, the inlet valve 640 corresponding to the inlet line 660 that feeds the bladder is opened. Pressurized fluid then flows from the fluid supply source 600, through the inflow valve 620, into the manifold 625, through inlet valve 640, into the inlet line 660 and then into the bladder. To deflate a bladder, exhaust valve 630 is opened and inflow valve 620 is closed. Additionally, the inlet valve 640 corresponding to the inlet line 660 that fluidly communicates with the bladder is opened. Pressurized fluid then flows from the bladder, through the inlet line 660, through inlet valve 640, through the manifold 625 and out of the exhaust valve 630.

In the event the pressure in an inlet line 660 and a bladder in fluid communication with the input line exceeds a maximum pressure level, relief valve 650 may open, allowing fluid to escape to the atmosphere or to an exhaust conduit.

A preferred embodiment of the overlay mattress of the present invention allows a patient to be positioned in a variety of predetermined positions and/or moved from one position to another without adjusting the underlying table. Thus, the overlay mattress of the present invention acts as an independent patient-positioning device so that various surgical positions can be achieved even for surgical tables having only a flat patient-support platform or for tables having very limited articulation capabilities. The overlay mattress also allows the positioning of a patient to be fine-tuned when, for example, an adjustable surgical table is incapable of the precise positioning required for a particular surgical procedure. Thus, the overlay mattress can be used for any surgical table to enhance the patient-positioning capabilities of the particular table.

A preferred embodiment of the overlay mattress of the present invention also provides heating and/or cooling. Thus, the overlay mattress of the present invention may act as an independent thermal regulator.

Furthermore, a preferred embodiment of the overlay mattress of the present invention includes features to facilitate fluoroscopy and the taking of conventional X-rays. One such feature is the use of radiolucent materials such as rubber, plastics and carbon. Preferably the overlay mattress is substantially comprised of radiolucent materials. Components such as the fluid distribution system and a means for cooling, which may include radiopaque materials (i.e., materials that obstruct X-rays), are preferably located outside of the overaly mattress.

Figure 11:
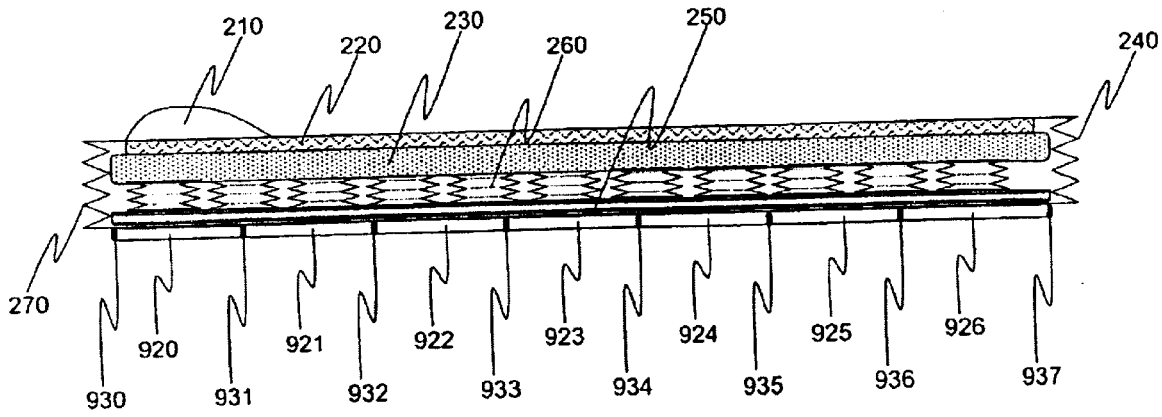
FIGS. 11*a* through 11*f* conceptually show various combinations of wedge-shaped bladders to achieve various inclined, declined and level planes for positioning.
Figure 11A:
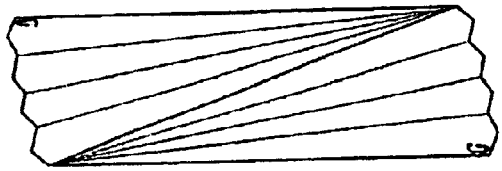
Figure 11B:
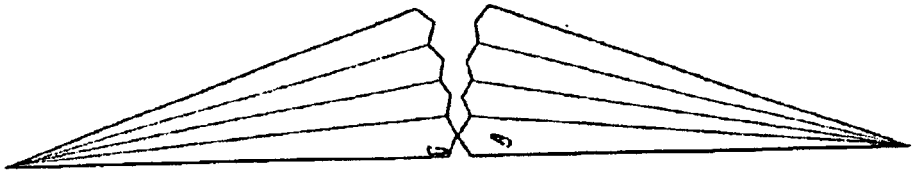
Figure 11C:
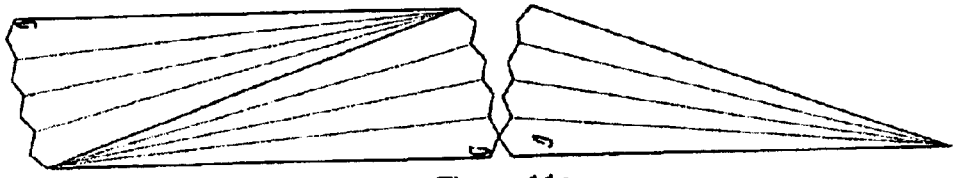
Figure 11D:
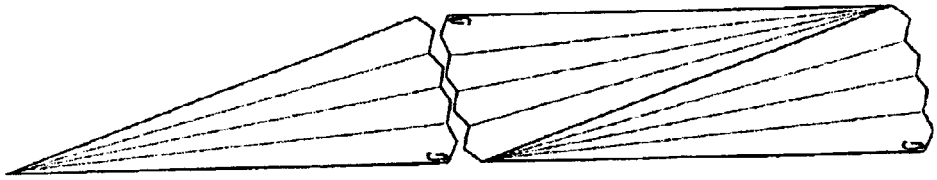
Figure 11E:
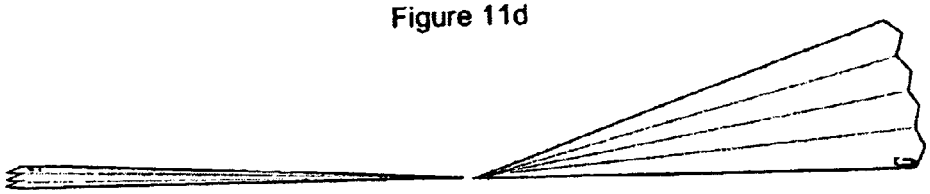
Figure 11F:
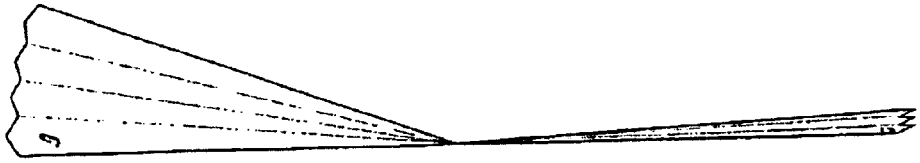

Another feature that facilitates the taking of conventional X-rays is a radiolucent X-ray cassette compartment layer, comprised of a plurality of user-accessible compartments 920 defined by support members 930, as illustrated in FIG. 11, for supporting the overlay mattress and providing space to insert and position X-ray cassettes. While it is preferably releasably attached to the overlay mattress, the X-ray cassette compartment layer may be permanently attached or may not be attached to the overlay mattress. The compartments 920 are sized to accommodate conventional X-ray cassettes.

In another embodiment of the present invention, pressure shifting means are included to reduce the risk of bed sore formation or exacerbation by dynamically shifting high pressure zones under a patient. For example, the lifting cell layer 240 in conjunction with the fluid distribution means 620–670 may provide pressure shifting. Pressure in certain lifting cell bladders may be increased from low to high while pressure in other such bladders may be decreased from high to low periodically. Controller 710 may be programmed to periodically adjust the pressure of determined bladders. The low-pressure bladders will create areas of reduced compression, facilitating blood flow to corresponding tissue of the patient.

Figure 13:
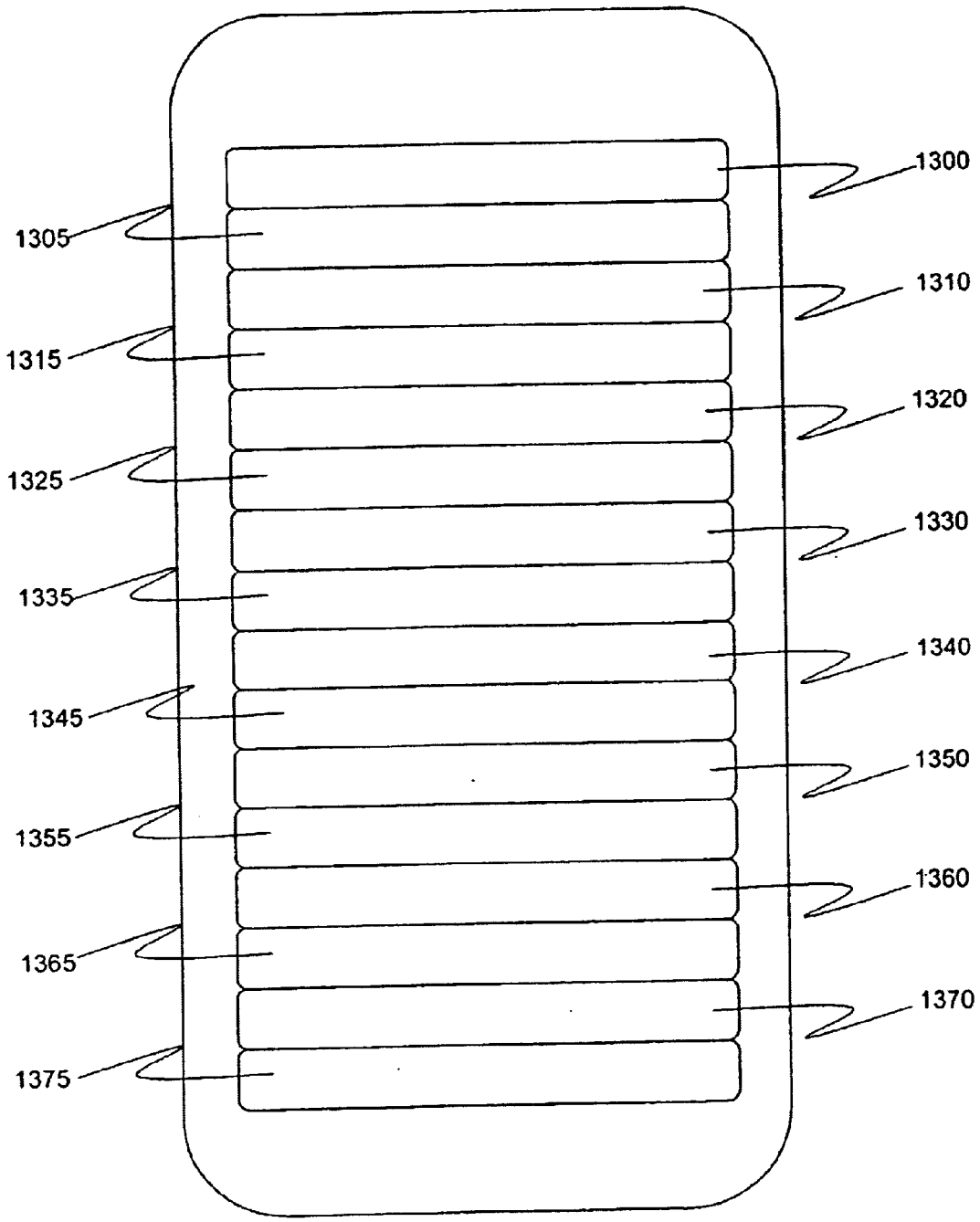
FIG. 13 conceptually shows a top view of an exemplary pressure shifting means comprised of a plurality of selectively inflatable bladders.

Alternatively, another layer of an overlay mattress according to the present invention may provide pressure shifting. For example, the thermal layer 220 or the cushion layer 230 may be comprised of a plurality of bladders for containing a fluid such as water or air. Illustratively, FIG. 13 conceptually shows such a layer comprised of a plurality of separately inflatable bladders 1300–1375. The layer may be approximately the size of the overlay mattress in length and width, or a size and shape sufficient to protect a susceptible area of a patient's body from bed sore formation.

Pressurization may be controlled using a fluid supply source and fluid distribution system as depicted in FIGS. 6 and 7. If the fluid is the same as the fluid supplied to bladders of the lifting cell layer, then the pressure shifting layer and lifting cell layer may share the same fluid supply source and fluid distribution system.

To illustrate operation, at time $t_1$, even numbered bladders (e.g., 1300, 1310, 1320, etc . . . ) may be inflated at a high pressure, while odd numbered bladders (e.g., 1305, 1315, 1325, etc . . . ) may be deflated or inflated at a low-pressure level. At time $t_2$, pressure in odd numbered bladders may be increased to the high-pressure level, and then pressure in the even numbered bladders may be decreased to the low-pressure level. At time $t_3$, pressure in even numbered bladders may be increased to the high-pressure level, and then pressure in the odd numbered bladders may be decreased to the low-pressure level, and so on. This cycle may be repeated throughout a procedure. The high pressure should be within the operating limits of the fluid supply source, fluid distribution system and bladders. It should also be sufficient to comfortably support the patient using the bladders at the high pressure. The low pressure should be sufficiently low to relieve compressive forces from areas of the patient's body in contact with the patient support surface of the overlay mattress proximate to the bladders at low pressure. The cycle should be repeated periodically, at a frequency well within operating capacity of the fluid supply and distribution means, but frequently enough to reduce the risk of pressure sore formation based on the patient's age and condition. For example, the time difference from $t_2$ to $t_3$ may be one hour or less.

Figure 14:
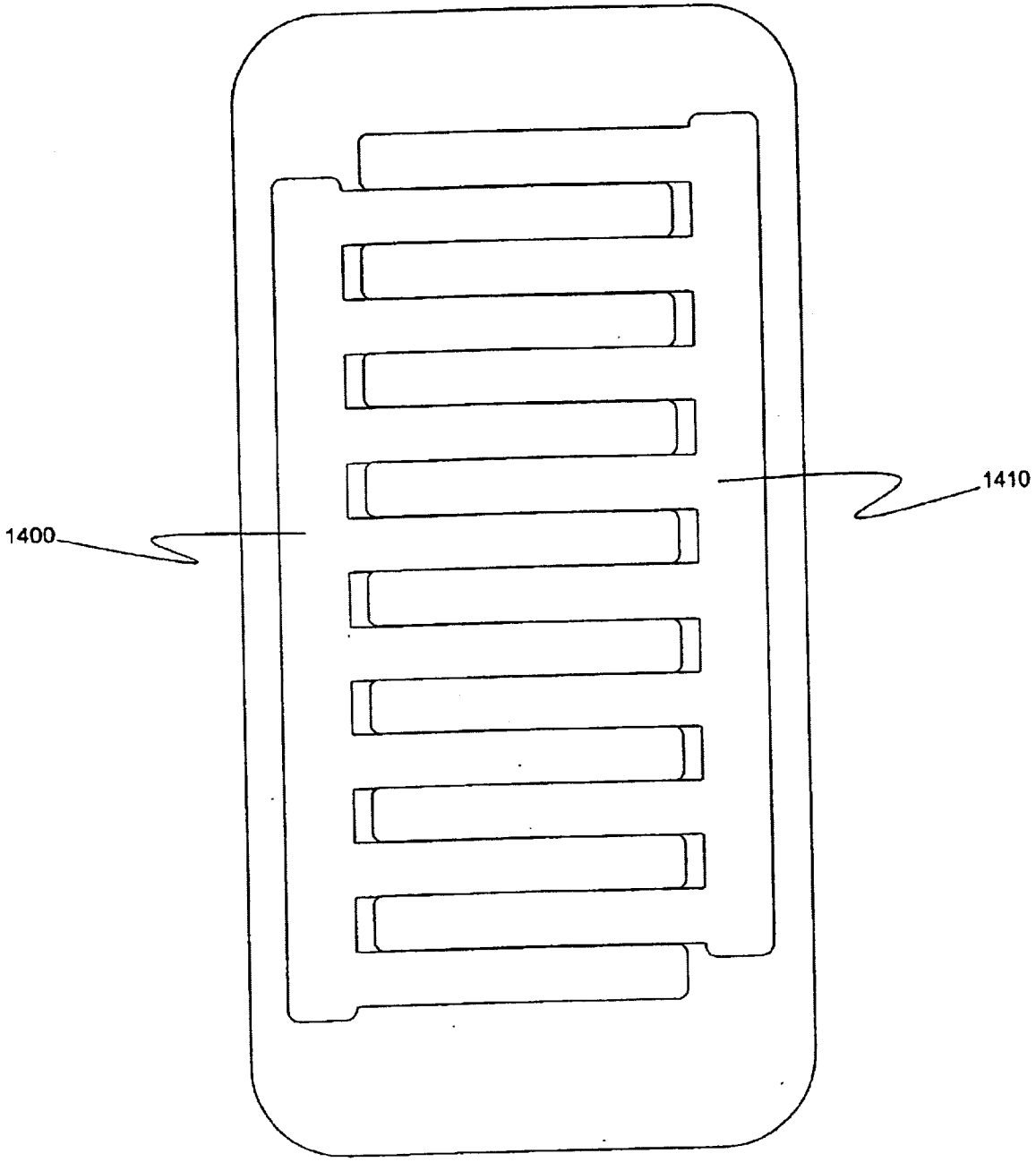
FIG. 14 conceptually shows a top view of another exemplary pressure shifting means comprised of a pair of selectively inflatable interleaved bladders.

As another example, FIG. 14 conceptually shows an alternative layer for providing pressure shifting. The layer includes two interleaved bladders, facilitating the inflation and deflation of adjacent zones to achieve the desired pressures. For example, at time $t_1$, bladder 1400 may be at a high pressure, while bladder 1410 may be established at a low-pressure level. At time $t_2$, pressure in bladder 1410 may be increased to the high-pressure level, and then pressure in the bladder 1400 may be decreased to the low pressure. At time $t_3$, pressure in bladder 1400 may be increased to the high-pressure level, and then pressure in bladder 1410 may be decreased to the low pressure, and so on.

Those skilled in the art will appreciate that certain internal layers of the overlay mattress may serve multiple functions. For example, the pressure shifting bladders may contain a thermal fluid, thereby providing thermal regulation in addition to shifting pressure to reduce the risk of bed sores. The pressure shifting bladders may also serve as the cushion layer of the overlay mattress. Additionally, the thermal layer may serve as the cushion layer, and vice versa. Thus, for example, one layer of the overlay mattress may be a thermal layer, cushion layer and pressure shifting layer. Such multi-function layers, combinations of layers and similar embodiments come within the scope of the subject invention.

The detailed description of a particular preferred embodiment, set forth above to enable one to implement the invention, is not intended to limit the enumerated claims, but to serve as a particular example thereof. Those skilled in the art should appreciate that they can readily use the concepts and specific embodiments and implementations disclosed as bases for modifying or designing other mattresses and overlay mattresses for carrying out the same purposes of the present invention. Those skilled in the art should also realize that such equivalent mattresses and overlay mattresses do not depart from the spirit and scope of the invention in its broadest form.

Having thus described the present invention, what is claimed as new and desired to be secured by Letters Patent is as follows:

1. An overlay mattress having a patient support surface, said overlay mattress including:

a) a cushion layer;

b) a lifting cell layer comprised of a plurality of lifting cells for elevating portions of the overlay mattress;

c) a bottom layer; and d) an overlay mattress cover, and said overlay mattress cover including four sides and a plurality of pleats along one or more of said four sides to facilitate expansion.

2. An overlay mattress as in claim 1, said overlay mattress further comprising releasable attaching means for releasably attaching the lifting cells to the bottom layer.

3. An overlay mattress as in claim 1, said overlay mattress further comprising releasable attaching means for releasably attaching the overlay mattress to a support surface.

4. An overlay mattress as in claim 1, said overlay mattress further comprising a thermal layer for controlling the temperature of the patient support surface, said thermal layer being in thermal communication with the patient support surface.

5. An overlay mattress as in claim 4, wherein the thermal layer includes:

a) an electrical heating element, and b) a heating controller for controlling the temperature of the electrical heating element.

6. An overlay mattress as in claim 4, wherein the overlay mattress further includes a means for regulating the temperature of a thermal fluid, and the thermal layer includes a thermal bladder for containing the thermal fluid.

7. An overlay mattress as in claim 6, wherein the means for regulating the temperature of the thermal fluid includes a means for heating the thermal fluid.

8. An overlay mattress as in claim 6, wherein the means for regulating the temperature of the thermal fluid includes a means for cooling the thermal fluid.

9. An overlay mattress as in claim 6, wherein the means for regulating the temperature of the thermal fluid includes a means for heating the thermal fluid and a means for cooling the thermal fluid.

10. An overlay mattress as in claim 1, said overlay mattress cover including a) four sides, a patient support surface and a bottom; and b) a puncture resistant material comprising the patient support surface and at least one of said four sides.

11. An overlay mattress as in claim 1, said overlay mattress cover including a fluid impermeable material.

12. An overlay mattress as in claim 1, said overlay mattress being substantially comprised of radiolucent materials.

13. An overlay mattress as in claim 1, said overlay mattress further including a layer of compartments for receiving X-ray cassettes.

14. An overlay mattress as in claim 1, said overlay mattress further including a pillow.

15. An overlay mattress as in claim 14, said pillow being comprised of an inflatable bladder.

16. An overlay mattress as in claim 14, said pillow being comprised of an inflatable bladder having a generally horseshoe shape, said inflatable bladder being capable of supporting and elevating a patient's head in a face-down position, when said inflatable bladder is inflated, without obstructing the patient's breathing.

17. An overlay mattress as in claim 1, said overlay mattress further including a pressure shifting layer.

18. An overlay mattress as in claim 17, said pressure shifting layer including a plurality of fluid inflatable bladders and means for supplying a fluid from a fluid supply source.

19. An overlay mattress as in claim 18, said means for supplying a fluid including means for controlling the amount of fluid in each of said plurality of fluid inflatable bladders.

20. An overlay mattress as in claim 19, said means for controlling the amount of fluid including pressure sensor means for determining a fluid pressure in each of said plurality of fluid inflatable bladders.

21. An overlay mattress as in claim 20, said means for controlling the amount of fluid further including means for controlling the amount of fluid to achieve:

a) a first fluid pressure at a first time and a second fluid pressure at a second time in at least one of said plurality of fluid inflatable bladders, and b) the second fluid pressure at the first time and the first fluid pressure at the second time in at least one other of said plurality of fluid inflatable bladders.

22. An overlay mattress as in claim 20, said means for controlling the amount of fluid further including means for controlling the amount of fluid to cycle between a first fluid pressure and a second fluid pressure at a determined frequency in at least one of said plurality of fluid inflatable bladders, and to cycle between the second pressure and the first fluid pressure at the determined frequency in at least one other of said plurality of fluid bladders.

23. An overlay mattress having a patient support surface, said overlay mattress including an overlay mattress cover, said mattress cover enclosing therein:

a) a cushion layer b) a lifting cell layer comprised of a plurality of lifting cells for elevating portions of the overlay mattress; and c) a bottom layer, wherein the lifting cells are comprised of fluid inflatable bladders and the lifting cells include bellows-like pleats to facilitate expansion.

24. An overlay mattress as in claim 23, wherein the lifting cells include at least one wedge-like inflatable bladder.

25. An overlay mattress as in claim 23, wherein the lifting cell layer includes at least one pair of stacked fluid inflatable bladders.

26. An overlay mattress as in claim 23, further including a reforming means between adjacent fluid inflatable bladders.

27. An overlay mattress as in claim 26, wherein said reforming means is comprised of a foam rubber insert.

28. An overlay mattress as in claim 26, wherein said reforming means includes a plurality of plastic sleeves for constraining the fluid inflatable bladders upon inflation, each of said plastic sleeves having an opening at a top and an opening at a bottom and having a cross-section shape substantially similar to the cross-section shape of the fluid inflatable bladder being constrained.

29. An overlay mattress as in claim 23, further including an inflow line for delivering fluid from a fluid supply source to said bladders.

30. An overlay mattress as in claim 29, further including a fluid distribution system, said fluid distribution system controlling the delivery of fluid to said bladders, and being interposed between said inflow line and said bladders and in fluid communication with said inflow line and said bladders.

31. An overlay mattress as in claim 30, wherein said fluid distribution system includes an inflow valve, a manifold, and a plurality of inlet valves, said inflow valve controlling the delivery of fluid from the fluid supply source to the manifold and being interposed between and in fluid communication with said inflow line and said manifold, and each of said plurality of inlet valves controlling the delivery of fluid from the manifold to one or more of said bladders and being interposed between and in fluid communication with said manifold and the one or more of said bladders.

32. An overlay mattress as in claim 31, wherein said fluid distribution system further includes an exhaust valve, said exhaust valve being in fluid communication with said manifold and allowing fluid to escape from said manifold when said exhaust valve is opened.

33. An overlay mattress as in claim 31, said inlet valves being electronically activated valves.

34. An overlay mattress as in claim 33, said electronically activated valves being piezoelectric valves.

35. An overlay mattress as in claim 33, said electronically activated valves being solenoid valves.

36. An overlay mattress as in claim 33, said fluid distribution system further including an electronic means for controlling the activation of said electronically activated valves.

37. An overlay mattress as in claim 36, said electronic means for controlling the activation of said electronically activated valves including:

a) a programmable logic controller in electronic communication with said electronically activated valves, said programmable logic controller including:

i) means for receiving input signals, said input signals being representative of said electronically activated valves to open or close, and ii) means for producing output signals in response to said input signals, said output signals being communicated to said electronically activated valves and activating one or more of said electronically activated valves.

38. An overlay mattress as in claim 37, said electronic means for controlling the activation of said electronically activated valves further including means for a user to provide input signals to said programmable logic controller.

39. An overlay mattress as in claim 38, said means for a user to provide input signals to said programmable logic controller further including means for providing input signals representative of a desired overlay mattress position, said input signals representative of a desired overlay mattress position causing said programmable logic controller to produce output signals in response thereto, said output signals in response thereto being communicated to said electronically activated valves and activating one or more of said electronically activated valves to allow fluid to enter or exit bladders and achieve the desired overlay mattress position.

40. A modular overlay mattress having a patient support surface, said overlay mattress including a removable overlay mattress cover enclosing therein:

a) a removable cushion layer, b) a removable lifting cell layer comprised of a plurality of removable lifting cells for elevating portions of the overlay mattress;

c) a removable bottom layer;

d) a removable thermal layer for controlling the temperature of the patient support surface; and e) removable inserts for replacing said lifting cells removed from the modular overlay mattress.

41. A modular mattress as in claim 40, said removable inserts being comprised of foam rubber.

42. A modular overlay mattress as in claim 40, said modular overlay mattress further comprising a removable pressure shifting layer.

43. A method of reducing the risk of bedsore formation, said method comprising the steps of:

a) providing an overlay mattress according to claim 22;

b) laying a patient on a patient support surface of the overlay mattress;

c) cycling at least one of said plurality of fluid inflatable bladders in the vicinity of an area of the patient's body susceptible to bedsore formation between a first fluid pressure and a second fluid pressure at a determined frequency; and d) cycling at least one other of said plurality of fluid inflatable bladders in the vicinity of an area of the patient's body susceptible to bedsore formation between the second fluid pressure and the first fluid pressure at the determined frequency.

* * * * *